United States Patent [19]

Bergeron et al.

[11] 3,935,094

[45] Jan. 27, 1976

[54] MAGNETIC SEPARATION OF ILMENITE

[75] Inventors: Michel Bergeron, Tracy; Stephen Frederick Prest, St-Lambert, both of Canada

[73] Assignee: Quebec Iron and Titanium Corporation - Fer et Titane du Quebec, Incorporated, Sorel, Canada

[22] Filed: Oct. 10, 1974

[21] Appl. No.: 513,893

[52] U.S. Cl. ..... 209/8; 209/214; 423/80

[51] Int. Cl.[2] ..... B03C 1/02

[58] Field of Search ..... 209/4, 11, 8, 214, 3; 75/1 TI; 423/53, 69, 80

[56] References Cited

UNITED STATES PATENTS

| | | | |
|---|---|---|---|
| 2,975,897 | 3/1961 | Presgrave | 209/214 |
| 3,608,718 | 9/1971 | Aubrey | 209/214 |

FOREIGN PATENTS OR APPLICATIONS

| | | | |
|---|---|---|---|
| 640,582 | 5/1962 | Canada | 209/8 |
| 856,508 | 3/1940 | France | 423/80 |

OTHER PUBLICATIONS

Chem. Abst., 64, 1966, 1690e.
E/MJ, Mar., 1961, 170, p. 165.
E/MJ, Sept., 1943, 144, pp. 62–65.

*Primary Examiner*—Robert Halper

[57] ABSTRACT

Purification of ilmenite from chromite impurities by a two step magnetic separation wherein magnetically susceptible chromite is magnetically removed, followed by an oxidizing roasting of the ilmenite and a subsequent magnetic separation of ilmenite from the remaining chromite impurities to obtain an ilmenite with 1% or less chromite.

8 Claims, 2 Drawing Figures

* IN PERCENT BASED ON ORIGINAL CONCENTRATE

Figure 1:
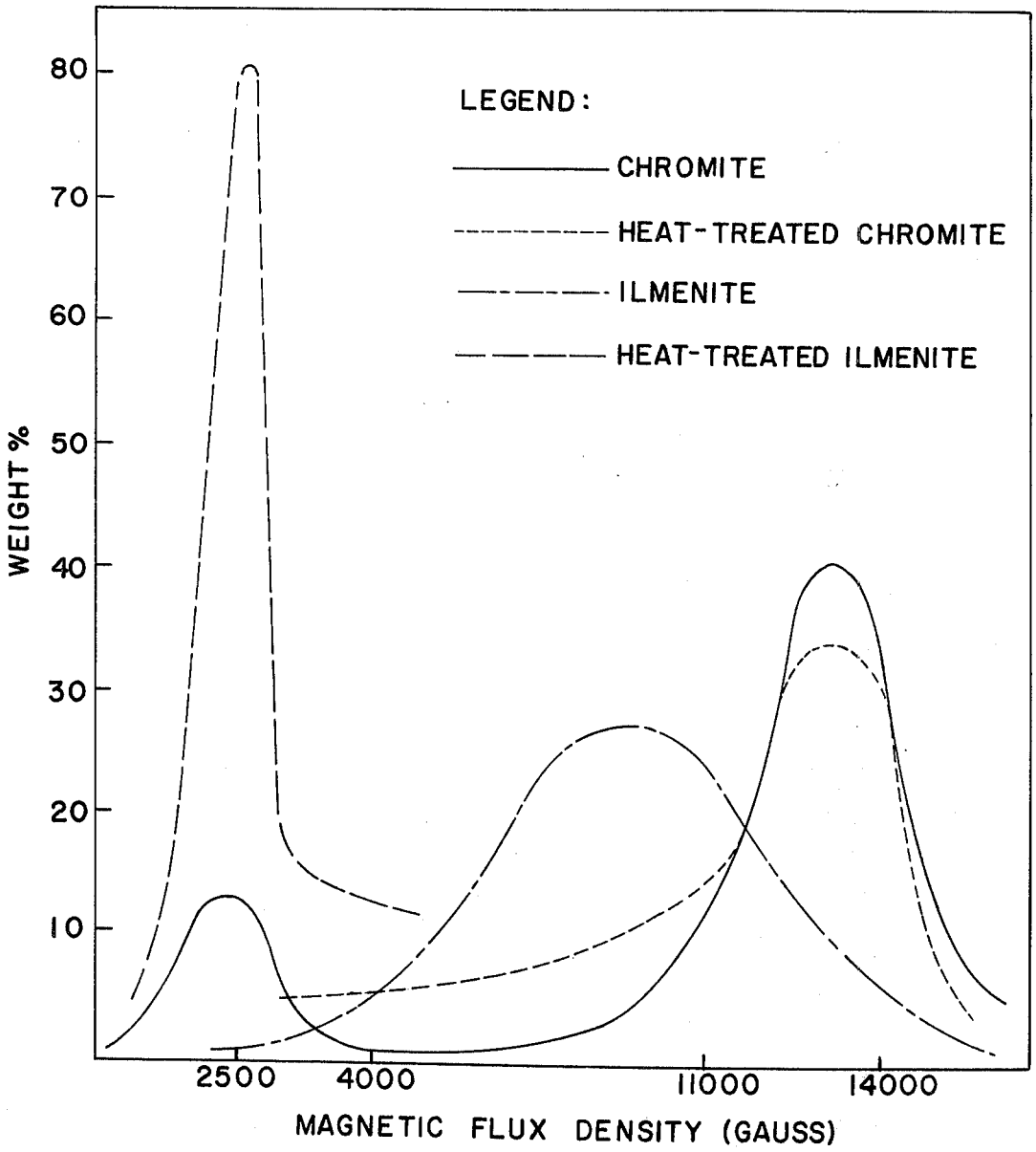

RELATIVE MAGNETIC SUSCEPTIBILITIES OF ILMENITE AND CHROMITE (RICHARD'S BAY) BEFORE AND AFTER HEATING IN AIR AT 750° C FOR 15 MINUTES.

* IN PERCENT BASED ON ORIGINAL CONCENTRATE

MAGNETIC SEPARATION OF ILMENITE

This invention pertains to purification of ilmenite; more specifically, this invention pertains to purification of ilmenite concentrates whereby the chromite fraction thereof is removed with simple processing steps to the levels found to be acceptable for ilmenite in its various applications. Still further, this invention pertains to a two step magnetic separation of ilmenite whereby ilmenite of very low chromium concentration is obtained as a result of the two step coaction.

BRIEF DESCRIPTION OF BACKGROUND OF INVENTION AND PRIOR ART

Ilmenite has served as a starting material for obtaining titanium dioxide of various degrees of purity. Generally when producing titanium dioxide by the sulphate route, it is important that ilmenite be as free of chromium as possible. It is also very essential that the purity of the raw ilmenite material be as high as possible so that the ilmenite may be used for other purposes. However, it is not only essential that ilmenite be pure for obtaining titanium dioxide by the above mentioned process but that it be substantially free of chromium when ilmenite is used for other purposes such as for producing titanium carbide which is suitable as a component in welding rod coatings as a precursor thereof.

Various investigations have heretofore been conducted for the separation of chromites from ilmenite and these have generally relied upon the magnetic properties of the chromite present in ilmenite.

The magnetic behavior of ilmenite and the susceptibility of the same to magnetic treatment is fairly well illustrated in the article authored by Westcott et al., Journal of Geophysical Research, Volume 73, No. 4, Pages 1269 to 1277 (1968) (Australian). Based on the disclosure in this article, the magnetic properties of ilmenite are fairly well understood such as the function of particle sizes as well as treatment of the same under oxidizing conditions.

Substantial laboratory investigation about the separation of chromites from ilmenite from various sources has been set forth in Investigation Report No. 461 dated Oct. 3, 1953 carried out under the auspices of Commonwealth Scientific and Research Organization in the Mining Department of the University of Melbourne. In that report, it has been concluded that magnetic separation of ilmenite is attractive especially if the ilmenite is treated under oxidizing conditions and the enhanced magnetic susceptibility of the ilmenite utilized to convert it to magnetically more active species vis-a-vis the chromite impurity in the ilmenite. In this article, it has been specifically mentioned that magnetic separation of the ilmenite prior to its oxidization and subsequent recovery of the chromite has not improved the recovery of ilmenite or enhanced the separation of chromites to the final chromium content required for a good quality sulphate feed stock.

Consequently, this article describes the separation of ilmenite to a degree which is still unacceptable for many purposes desired by the end users.

DESCRIPTION OF INVENTION AND EMBODIMENTS THEREOF

It has now been discovered that if ilmenite is purified in accordance with a combination of steps which must cooperate with each other in order to contribute to the total end result, the separation heretofore sought to be obtained can readily and elegantly be achieved by relying upon both the magnetic properties of the ilmenite and chromite both before and after the treatment of the ilmenite and chromite in an oxidizing atmosphere under specific conditions. Thus, not only the preceding treatment becomes extremely critical but the subsequent treatment requires the critical interrelationship of the preceding or first step treatment.

Consequently, it has been discovered that if ilmenite is purified magnetically before it is rendered magnetically susceptible in a vastly enhanced manner, the chromite species which are magnetically highly susceptible can be separated from the ilmenite. Thereafter, the treatment of the ilmenite by oxidization at a specific and narrow temperature range produces a magnetically very active ilmenite which can then be separated as the magnetically active fraction from the residual chromite which has different magnetic properties than the enhanced ilmenite. Thus, it has been discovered that the prior removal of the magnetically susceptible chromites enhances the purification and yields of the ilmenite rendered magnetically susceptible of oxidization. By the second step separation of the residual chromites as non-magnetics, a cleaner separation and a more pure ilmenite has been obtained.

DESCRIPTION OF INVENTION AND EMBODIMENTS THEREOF

In accordance with the invention, it has now been found that ilmenite from various sources can be purified. Ores which provide the ilmenite are those found on the east coast of South Africa, e.g., Richard's Bay and Ste. Lucia, and on the east coast of Australia, e.g., Stradbrooke Island. Richard's Bay ore which has been concentrated has an assay of 47.5 percent $TiO_2$; 36.5 percent Fe and 0.40 percent $Cr_2O_3$. The ilmenite concentrate is then subjected to a magnetic separation in a wet separation process and the high magnetically susceptible chromite contaminant is removed therefrom.

The assay of the magnetics which are separated from the primary concentrate consists of chromite and $Cr_2O_3$ bearing mineral of about 20 percent of the chromite present in the primary concentrate. As indicated above, the primary concentrate contains 0.40 percent chromite expressed as $Cr_2O_3$.

The non-magnetics from the separation step are ilmenite and chromite impurities associated therewith.

The non-magnetics are then subjected to roasting under oxidizing conditions at a temperature between 690°C to 810°C, but preferably at 750°C for a period from ten minutes to forty-five minutes, but preferably for fifteen minutes.

The roasting of the particles may be achieved in known process equipment such as a fluidized bed or rotary kiln as the means for heating the ilmenite particles. The fuel being augmented with up to 15 percent $O_2$ but preferably 1 percent to 5 percent excess of oxygen with respect to the stoichiometric requirements for the burning of the fuel and combustible impurities.

With respect to the amount of oxygen as the stoichiometric excess, it may range from 1 percent to 6 percent but preferably from 3 percent with respect to the amount of fuel used for the oxidization of the ilmenite material. A slight increase in weight of the ilmenite is observed during the oxidization.

Thereafter the oxidized ilmenite is magnetically highly susceptible and it is separated as the magnetics from the chromites. The ilmenite thus obtained contains 0.10 percent or less of $Cr_2O_3$ content or about 20 percent of the original chromite content in the Richard's Bay primary ilmenite.

Figure 2:
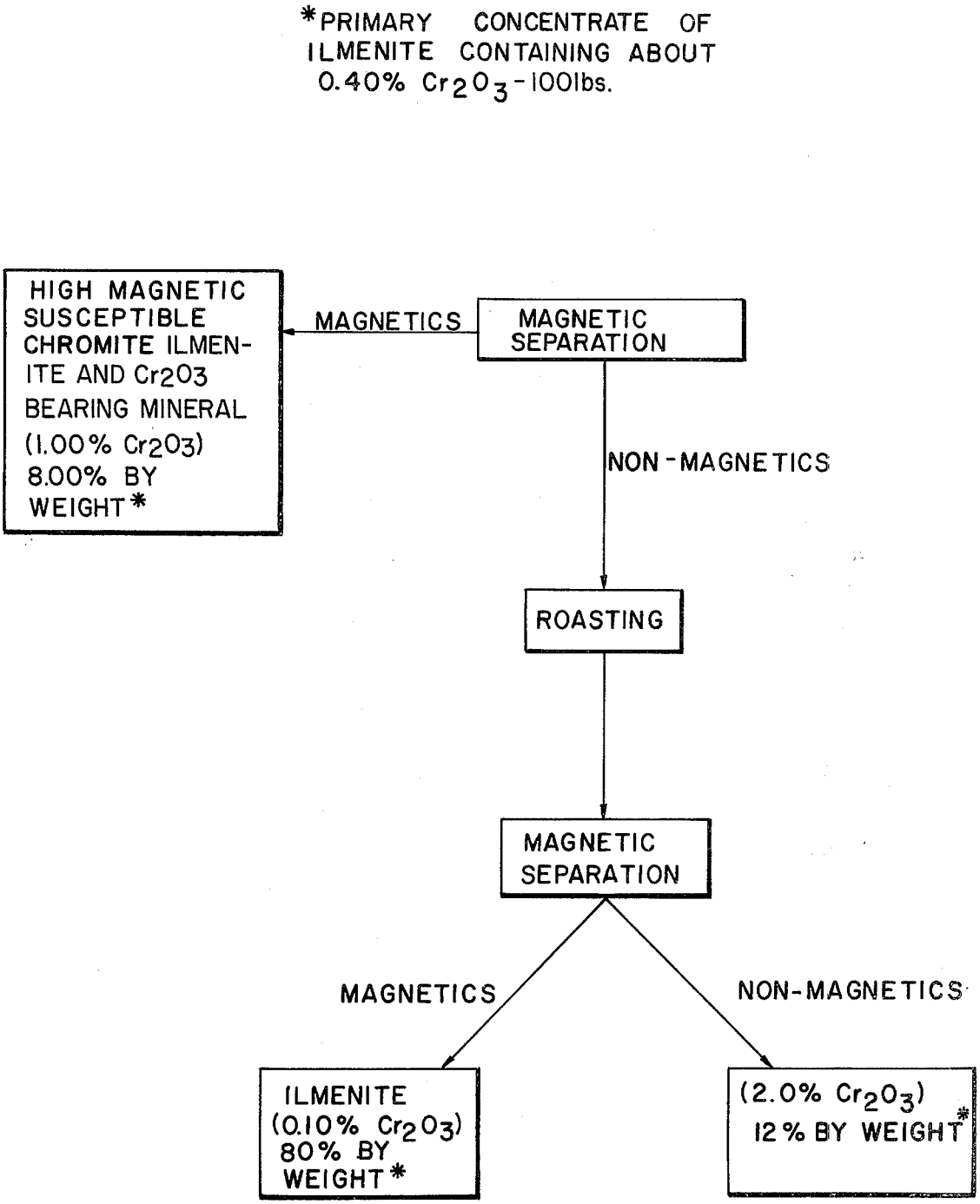

With reference to the figures herein:

FIG. 1, illustrates the magnetic susceptibility of the ilmenite described above as Richard's Bay ilmenite and it illustrates the increased magnetic susceptibility by heat treatment. At the same time, the chromite phase, the major $Cr_2O_3$ contaminant in the ore, is relatively unchanged. The gap between ilmenite and chromite is noteworthy as is the relative placement of peaks vis-a-vis the equivalent gauss value; and FIG. 2, illustrates a flow sheet showing the separation achieved when practicing the present invention.

The overall effect of the heat treatment is to increase the magnetic susceptibility gap between ilmenite and chromite which in turn facilitates the magnetic separation of the two minerals. However, the important pre-removal of the magnetic chromite provides the clean separation for the second separation. The chromite does not change very appreciably its magnetic characteristics vis-a-vis the non-oxidized species of ilmenite. On the other hand, ilmenite changes drastically and markedly its magnetic characteristics.

To sum up, it requires first the treatment of the ilmenite concentrate to remove the magnetically active species of chromite and chromite-containing minerals and the oxidation within a very narrow temperature and time span of non-magnetically active ilmenite concentrate to render it magnetically susceptible. The combination is necessary for the total removal of chromium and the magnetic separation of the ilmenite from the chromites in the final magnetic separation. In accordance with the novel method, recovery of up to 80 percent of the total ilmenite with the desired $Cr_2O_3$ level of 0.10 percent or less is possible by the above method. The residual chromium content in accordance with the above method is 0.10 percent or less by weight. (Example I and FIG. II.)

This compares with the best possible result of 50 percent recovery of the total ilmenite at 0.17 percent $Cr_2O_3$ obtained by separation on non-roasted material (Example II) and 65 percent recovery of 0.10 percent $Cr_2O_3$ concentrate (or 82 percent recovery of 0.14 percent $Cr_2O_3$) on roasted material if the prior magnetic step of eliminating the magnetically active species of chromite and high chromium bearing minerals is not carried out prior to the roasting.

EXAMPLE 1 a. A crude primary ilmenite containing 0.40 percent $Cr_2O_3$ was produced using a Readings 5 TPH high intensity wet magnet from the ilmenite bearing Richard's Bay beach sand deposit. This material was magnetically partitioned at 4000 gauss on the Readings high intensity wet magnetic separator to yield a magnetic fraction of 8 percent by weight containing 1.00 percent $Cr_2O_3$. The non-magnetic fraction was roasted in a fluid bed fueled by natural gas at 750°C with a 3 percent $O_2$ atmosphere with an average retention of 45 minutes. The combined fluid bed product (discharged and cyclone dust) was subjected to a magnetic separation at 2500 gauss. The magnetic fraction representing 80% of the original ilmenite and contained 0.10 percent $Cr_2O_3$ while the residual non-magnetics now contained 2.00 percent $Cr_2O_3$. FIG. II gives the flowsheet of magnetic fractionation of heat-treated ilmenite sand.

b. Concentrate which is used as a starting material and contains chromite of low magnetic susceptibility only. For the above material, the chromite of high magnetic susceptibility has been removed before roasting, using a high intensity wet magnetic separator. The new ilmenite concentrate which contains ilmenite and chromite of low magnetic susceptibility can then be roasted and fractioned using magnetic separations to yield an ilmenite product containing 0.10 percent $Cr_2O_3$ or less. In this instance the recovery is also greatly improved.

EXAMPLE II

A crude primary ilmenite containing 0.30 percent $Cr_2O_3$ was produced using a Reading 5 TPH high intensity wet magnet from the Richard's Bay black sand deposit. This material was magnetically partitioned at 4000 gauss on a Readings high intensity wet magnetic separator to yield a magnetic fraction of 8 percent by weight containing 1.00 percent $Cr_2O_3$. The non-magnetic fraction was not roasted but was passed over a high intensity magnetic separator a higher intensities. At 9000 gauss, a 70 percent yield of the ilmenite at 0.21 percent $Cr_2O_3$ was obtained. At 7,000 gauss a 50 percent yield of total ilmenite was obtained at 0.17 percent $Cr_2O_3$.

EXAMPLE III

A crude primary ilmenite containing 0.30 percent $Cr_2O_3$ was produced using a Reading's 5 TPH high intensity wet magnet separator from the Richard's Bay beach sand deposit. This material was roasted in a fluid bed fueled by natural gas at 750°C with a 3 percent $O_2$ atmosphere with an average retention time of 45 minutes. The combined fluid bed product was subjected to magnetic separation at 2500 gauss. The magnetic fraction represented 82 percent of the original ilmenite and contained 0.14 percent $Cr_2O_3$. A 0.10 percent $Cr_2O_3$ magnetic fraction was obtained from the above material in a 65 percent yield.

What is claimed is:

1. In a method for purifying ilmenite ore containing combustibles, the improvement comprising the steps of:

a. separating magnetically an ilmenite ore having liberated chromites present as impurities to remove magnetically susceptible chromium bearing minerals;

b. heating the thus treated ilmenite at a temperature from 690°C to 810°C for a period of at least ten minutes, said heating being in the presence of excess oxygen;

c. separating magnetically the thus heated ilmenite as the more magnetically susceptible species from the impurities therein;

e. recovering the magnetized ilmenite product having the reduced amount of chromites present.

2. The method as defined in claim 1 wherein the heating is in an oxidizing atmosphere having from minimum 1 percent $O_2$ of excess oxygen over the stoichiometric amount of fuel required to heat the ilmenite and the combustibles in said ilmenite.

3. The method as defined in claim 2 wherein the oxidizing atmosphere has minimum oxygen content of 1 percent above the stoichiometric amount required for the combustion of said fuel as well as the combustibles in said ilmenite.

4. The process as defined in claim 1 wherein the heating in the oxidizing atmosphere is at 750°C for 15 minutes.

5. In a method for purifying ilmenite ore containing combustibles the improvement comprising the steps of:

a. grinding an ilmenite ore having 0.40 percent chromites by weight percent as impurities, expressed as $Cr_2O_3$;

b. separating magnetically the ground ore to remove magnetically susceptible impurities including chromites;

c. heating the thus treated ilmenite at a temperature from 690°C to 810°C for a period of at least ten minutes, said heating being in the presence of oxygen;

d. separating magnetically the thus heated ilmenite as the more magnetically susceptible species from the impurities therein; and e. recovering the ilmenite product having the reduced amount of chromites present.

6. The method as defined in claim 5 wherein the heating is in an oxidizing atmosphere having from 1 to 6 percent of excess oxygen over the stoichiometric amount of fuel required to heat the ilmenite and the combustibles in said ilmenite.

7. The method as defined in claim 6 wherein the oxidizing atmosphere has oxygen content of 3 percent above the stoichiometric amount required for the combustion of said fuel as well as the combustibles in said ilmenite.

8. The process as defined in claim 5 wherein the heating in step c) is carried out in a fluidized bed.

* * * * *